US009013394B2

(12) United States Patent
Lin

(10) Patent No.: US 9,013,394 B2
(45) Date of Patent: Apr. 21, 2015

(54) DRIVING METHOD FOR ELECTROPHORETIC DISPLAYS

(75) Inventor: Craig Lin, San Jose, CA (US)

(73) Assignee: E Ink California, LLC, Fremont, CA (US)

( * ) Notice: Subject to any disclaimer, the term of this patent is extended or adjusted under 35 U.S.C. 154(b) by 604 days.

(21) Appl. No.: 13/152,140

(22) Filed: Jun. 2, 2011

(65) Prior Publication Data

US 2011/0298776 A1 Dec. 8, 2011

Related U.S. Application Data

(60) Provisional application No. 61/351,764, filed on Jun. 4, 2010.

(51) Int. Cl.
*G09G 3/34* (2006.01)
*G09G 3/00* (2006.01)

(52) U.S. Cl.
CPC ..... *G09G 3/001* (2013.01); *G09G 3/344* (2013.01)

(58) Field of Classification Search
CPC ..... G09G 3/344; G09G 3/001
USPC ..... 345/107, 211
See application file for complete search history.

(56) References Cited

U.S. PATENT DOCUMENTS

| | | | | |
|---|---|---|---|---|
| 4,143,947 | A | 3/1979 | Aftergut et al. | |
| 4,259,694 | A | 3/1981 | Liao | |
| 4,443,108 | A | 4/1984 | Webster | |
| 4,947,159 | A * | 8/1990 | Di Santo et al. | 345/107 |
| 5,266,937 | A | 11/1993 | DiSanto et al. | |
| 5,754,584 | A | 5/1998 | Durrant et al. | |
| 5,831,697 | A | 11/1998 | Evanicky et al. | |
| 5,923,315 | A | 7/1999 | Ueda et al. | |
| 6,005,890 | A | 12/1999 | Clow et al. | |
| 6,045,756 | A | 4/2000 | Carr et al. | |
| 6,069,971 | A | 5/2000 | Kanno et al. | |
| 6,111,248 | A | 8/2000 | Melendez et al. | |
| 6,154,309 | A | 11/2000 | Otani et al. | |
| 6,473,072 | B1 * | 10/2002 | Comiskey et al. | 345/173 |
| 6,532,008 | B1 | 3/2003 | Guranlnick | |
| 6,639,580 | B1 | 10/2003 | Kishi et al. | |
| 6,657,612 | B2 | 12/2003 | Machida et al. | |
| 6,671,081 | B2 | 12/2003 | Kawai | |
| 6,674,561 | B2 | 1/2004 | Ohnishi et al. | |
| 6,686,953 | B1 | 2/2004 | Holmes | |
| 6,796,698 | B2 | 9/2004 | Sommers et al. | |
| 6,903,716 | B2 | 6/2005 | Kawabe et al. | |

(Continued)

FOREIGN PATENT DOCUMENTS

| | | |
|---|---|---|
| WO | WO 2005/004099 | 1/2005 |
| WO | WO 2005/031688 | 4/2005 |

(Continued)

OTHER PUBLICATIONS

U.S. Appl. No. 12/046,197, filed Mar. 11, 2008, Wang et al.

(Continued)

*Primary Examiner* — Christopher E Leiby
(74) *Attorney, Agent, or Firm* — Perkins Coie LLP

(57) ABSTRACT

This application is directed to an electrophoretic display device in which the common electrode is not connected to a display driver. The driving method suitable for such a display device provides a low cost solution for many display applications.

7 Claims, 10 Drawing Sheets

(56) References Cited

U.S. PATENT DOCUMENTS

| | | | | |
|---|---|---|---|---|
| 6,914,713 | B2 | 7/2005 | Chung et al. | |
| 6,970,155 | B2 | 11/2005 | Cabrera | |
| 6,982,178 | B2 * | 1/2006 | LeCain et al. | 438/22 |
| 6,995,550 | B2 | 2/2006 | Jacobson et al. | |
| 7,034,783 | B2 * | 4/2006 | Gates et al. | 345/84 |
| 7,177,066 | B2 | 2/2007 | Chung et al. | |
| 7,242,514 | B2 | 7/2007 | Chung et al. | |
| 7,283,119 | B2 | 10/2007 | Kishi | |
| 7,349,146 | B1 | 3/2008 | Douglass et al. | |
| 7,504,050 | B2 | 3/2009 | Weng et al. | |
| 7,710,376 | B2 | 5/2010 | Edo et al. | |
| 7,733,311 | B2 | 6/2010 | Amundson et al. | |
| 7,800,580 | B2 | 9/2010 | Johnson et al. | |
| 7,839,381 | B2 | 11/2010 | Zhou et al. | |
| 7,952,558 | B2 | 5/2011 | Yang et al. | |
| 7,999,787 | B2 | 8/2011 | Amundson et al. | |
| 8,035,611 | B2 | 10/2011 | Sakamoto | |
| 8,044,927 | B2 * | 10/2011 | Inoue | 345/107 |
| 8,054,253 | B2 | 11/2011 | Yoo | |
| 8,081,155 | B2 * | 12/2011 | Kajino | 345/107 |
| 2002/0021483 | A1 | 2/2002 | Katase | |
| 2002/0033792 | A1 | 3/2002 | Inoue | |
| 2003/0095090 | A1 | 5/2003 | Ham | |
| 2003/0095094 | A1 * | 5/2003 | Goden | 345/107 |
| 2003/0137521 | A1 | 7/2003 | Zehner et al. | |
| 2004/0027327 | A1 * | 2/2004 | LeCain et al. | 345/107 |
| 2004/0227746 | A1 | 11/2004 | Shih | |
| 2004/0246562 | A1 | 12/2004 | Chung et al. | |
| 2004/0263450 | A1 | 12/2004 | Lee et al. | |
| 2005/0001812 | A1 | 1/2005 | Amundson et al. | |
| 2005/0162377 | A1 | 7/2005 | Zhou et al. | |
| 2005/0179642 | A1 | 8/2005 | Wilcox et al. | |
| 2005/0185003 | A1 | 8/2005 | Dedene et al. | |
| 2005/0210405 | A1 | 9/2005 | Ernst et al. | |
| 2005/0219184 | A1 | 10/2005 | Zehner et al. | |
| 2006/0050361 | A1 | 3/2006 | Johnson | |
| 2006/0132426 | A1 | 6/2006 | Johnson | |
| 2006/0139305 | A1 | 6/2006 | Zhou et al. | |
| 2006/0139309 | A1 | 6/2006 | Miyasaka | |
| 2006/0164405 | A1 | 7/2006 | Zhou | |
| 2006/0187186 | A1 | 8/2006 | Zhou et al. | |
| 2006/0192751 | A1 | 8/2006 | Miyasaka et al. | |
| 2006/0262147 | A1 | 11/2006 | Kimpe et al. | |
| 2006/0279527 | A1 * | 12/2006 | Zehner et al. | 345/107 |
| 2007/0035510 | A1 | 2/2007 | Zhou et al. | |
| 2007/0046621 | A1 | 3/2007 | Suwabe et al. | |
| 2007/0046625 | A1 | 3/2007 | Yee | |
| 2007/0052668 | A1 | 3/2007 | Zhou et al. | |
| 2007/0070032 | A1 | 3/2007 | Chung et al. | |
| 2007/0080926 | A1 | 4/2007 | Zhou et al. | |
| 2007/0080928 | A1 | 4/2007 | Ishii et al. | |
| 2007/0103427 | A1 | 5/2007 | Zhou et al. | |
| 2007/0109274 | A1 | 5/2007 | Reynolds | |
| 2007/0132687 | A1 | 6/2007 | Johnson | |
| 2007/0146306 | A1 | 6/2007 | Johnson et al. | |
| 2007/0159682 | A1 | 7/2007 | Tanaka et al. | |
| 2007/0182402 | A1 | 8/2007 | Kojima | |
| 2007/0188439 | A1 | 8/2007 | Kimura et al. | |
| 2007/0200874 | A1 | 8/2007 | Amundson et al. | |
| 2007/0247417 | A1 | 10/2007 | Miyazaki et al. | |
| 2007/0262949 | A1 | 11/2007 | Zhou et al. | |
| 2007/0276615 | A1 | 11/2007 | Cao et al. | |
| 2007/0296690 | A1 | 12/2007 | Nagasaki | |
| 2008/0150886 | A1 | 6/2008 | Johnson et al. | |
| 2008/0211833 | A1 | 9/2008 | Inoue | |
| 2008/0303780 | A1 | 12/2008 | Sprague et al. | |
| 2009/0096745 | A1 | 4/2009 | Sprague et al. | |
| 2009/0267970 | A1 | 10/2009 | Wong et al. | |
| 2009/0309870 | A1 * | 12/2009 | Takei | 345/214 |
| 2010/0134538 | A1 | 6/2010 | Sprague et al. | |
| 2010/0194733 | A1 | 8/2010 | Lin et al. | |
| 2010/0194789 | A1 | 8/2010 | Lin et al. | |
| 2010/0238203 | A1 | 9/2010 | Stroemer et al. | |
| 2010/0271408 | A1 * | 10/2010 | Lin et al. | 345/690 |
| 2010/0283804 | A1 | 11/2010 | Sprague et al. | |
| 2010/0295880 | A1 | 11/2010 | Sprague et al. | |
| 2011/0096104 | A1 | 4/2011 | Sprague et al. | |
| 2011/0134106 | A1 * | 6/2011 | Reis et al. | 345/213 |
| 2011/0298776 | A1 | 12/2011 | Lin | |
| 2012/0120122 | A1 | 5/2012 | Lin et al. | |
| 2012/0274671 | A1 | 11/2012 | Sprague et al. | |
| 2012/0320017 | A1 | 12/2012 | Sprague et al. | |

FOREIGN PATENT DOCUMENTS

| | | |
|---|---|---|
| WO | WO 2005/034076 | 4/2005 |
| WO | WO 2009/049204 | 4/2009 |
| WO | WO 2010/132272 | 11/2010 |

OTHER PUBLICATIONS

U.S. Appl. No. 12/115,513, filed May 5, 2008, Sprague et al.
U.S. Appl. No. 13/004,763, filed Jan. 11, 2011, Lin et al.
U.S. Appl. No. 13/009,711, filed Jan. 19, 2011, Lin.
U.S. Appl. No. 13/041,277, filed Mar. 4, 2011, Chan et al.
Kao, WC., (Feb. 2009) Configurable Timing Controller Design for Active Matrix Electrophoretic Display. *IEEE Transactions on Consumer Electronics*, 2009, vol. 55, Issue 1, pp. 1-5.
Kao, WC., YE, JA., Lin, FS., Lin, C., and Sprague, R. (Jan. 2009) Configurable Timing Controller Design for Active Matrix Electrophoretic Display with 16 Gray Levels. *ICCE 2009 Digest of Technical Papers*, 10.2-2.
Kao, WC., Fang, CY., Chen, YY., Shen, MH., and Wong, J. (Jan. 2008) Integrating Flexible Electrophoretic Display and One-Time Password Generator in Smart Cards. *ICCE 2008 Digest of Technical Papers*, P4-3. (Int'l Conference on Consumer Electronics, Jan. 9-13, 2008).
Sprague, R.A. (May 18, 2011) *Active Matrix Displays for e-Readers Using Microcup Electrophoretics*. Presentation conducted at SID 2011, 49 Int'l Symposium, Seminar and Exhibition, May 15-May 20, 2011, Los Angeles Convention Center, Los Angeles, CA, USA.

* cited by examiner

Viewing Side

| | | | | |
|---|---|---|---|---|
| 1 | 2 | 3 | 4 | 5 |
| 6 | 7 | 8 | 9 | 10 |
| 11 | 12 | 13 | 14 | 15 |
| 16 | 17 | 18 | 19 | 20 |

Figure 6

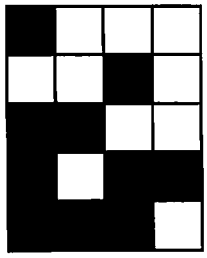
Figure 7a: Step 1
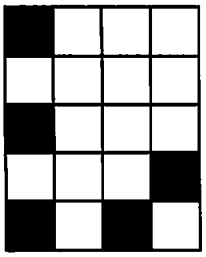
Figure 7b: Step 2
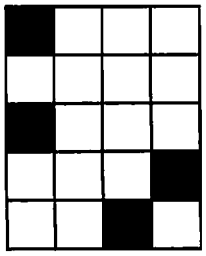
Figure 7c: Step 3

DRIVING METHOD FOR ELECTROPHORETIC DISPLAYS

This application claims priority to U.S. Provisional Application No. 61/351,764, filed Jun. 4, 2010; the content of which is incorporated herein by reference in its entirety.

TECHNICAL FIELD

The present invention relates to an electrophoretic display device and a driving method for such a display device.

BACKGROUND OF THE INVENTION

An electrophoretic display (EPD) is a non-emissive device based on the electrophoresis phenomenon of charged pigment particles suspended in a solvent. The display usually comprises two plates with electrodes placed opposing each other. One of the electrodes is usually transparent. A suspension composed of a colored solvent and charged pigment particles is enclosed between the two plates. When a voltage difference is imposed between the two electrodes, the pigment particles migrate to one side or the other, according to the polarity of the voltage difference. As a result, either the color of the pigment particles or the color of the solvent may be seen at the viewing side.

The two electrode layers of an electrophoretic display are individually connected to a driver so that appropriate voltages may be applied to the electrode layers. For the common electrode to be applied a voltage, a hole is usually drilled through the display panel connected to the common electrode to allow the common electrode to be connected to a driver. Alternatively, as described in US Patent Application Publication No. 2011-0080362, for a display panel attached to a common electrode but separate from a backplane, conductive contact pads are required to allow the common electrode to be connected to a driver. These methods for constructing an electrophoretic display require complex driving circuits and contact points, which lead to added costs.

SUMMARY OF THE INVENTION

The present invention is directed to an electrophoretic display device and a driving method for such a display device.

One aspect of the invention is directed to an electrophoretic display device, which comprises a) a plurality of display cells sandwiched between a floating common electrode and a backplane comprising multiple pixel electrodes and said backplane is connected to a display driver; and b) each of said display cells is filled with an electrophoretic fluid comprising charged pigment particles dispersed in a solvent or solvent mixture.

In one embodiment, the backplane is a permanent feature of the display device. In another embodiment, the backplane is connected to said plurality of display cells only when the display device is in the driving mode.

The voltage of said floating common electrode is calculated from the following equation:

$$V_{com}=\Sigma(V_{(i)}x\%\text{ of the pixels}(i)\text{ in the total number of pixels})$$

and is substantially zero, wherein "i" indicates a particular group of pixels.

In one embodiment, the display device is an information display device. In one embodiment, the display device is an electronic price tag.

Another aspect of the invention is directed to a driving method for a display device as described above, which method comprises:

a) applying a +V to a first group of pixels;

b) applying a −V to a second group of pixels; and c) applying 0V to the remaining pixels, if any, wherein the voltage of the floating common electrode, $$V_{com}=(+V)\times(\%\text{ of the first group of pixels in all pixels})+(-V)\times(\%\text{ of the second group of pixels in all pixels})+(0V)\times(\%\text{ of the remaining pixels, if any, in all pixels})$$

and is substantially zero.

In one embodiment, the backplane in said display device is connected to said plurality of display cells only when the display device is in the driving mode.

A further aspect of the invention is directed to a driving method for a display device as described above, wherein the display device is of a binary system comprising a first color and a second color, which method comprises a) applying a voltage of $V_1$ for a period of $t_1$ and then a voltage of $V_2$ for a period of $t_2$, to a first group of pixels to drive said pixels to the first color state or to remain in the first color state;

b) applying a voltage of $V_3$ for a period of $t_3$ and then a voltage of $V_4$ for a period of $t_4$, to a second group of pixels to drive said pixels to the second color state or to remain in the second color state; and c) applying 0V to the remaining pixels, if any, wherein the voltage of the floating common electrode, $$V_{com}=V_2\times(\%\text{ of the first group of pixels in all pixels})+V_4\times(\%\text{ of the second group of pixels in all pixels})+0V\times(\%\text{ of the remaining pixels, if any, in all pixels})$$

and is substantially zero, and $t_2=t_4$.

In one embodiment, the method further comprises the sum of $$V_1\times(\%\text{ of the first group of pixels in all pixels})+V_3\times(\%\text{ of the second group of pixels in all pixels})+0V\times(\%\text{ of the remaining pixels, if any, in all pixels})$$

is also substantially zero, and $t_1=t_3$.

In one embodiment, the first and second colors are black and white respectively.

The driving method of the present invention provides a low cost solution for many display applications.

BRIEF DESCRIPTION OF THE DRAWINGS

FIG. 6 depicts an image of 20 pixels.

FIGS. 7*a*-7*c* are a graphic illustration of the present driving method.

DETAILED DESCRIPTION OF THE INVENTION

Figure 1:
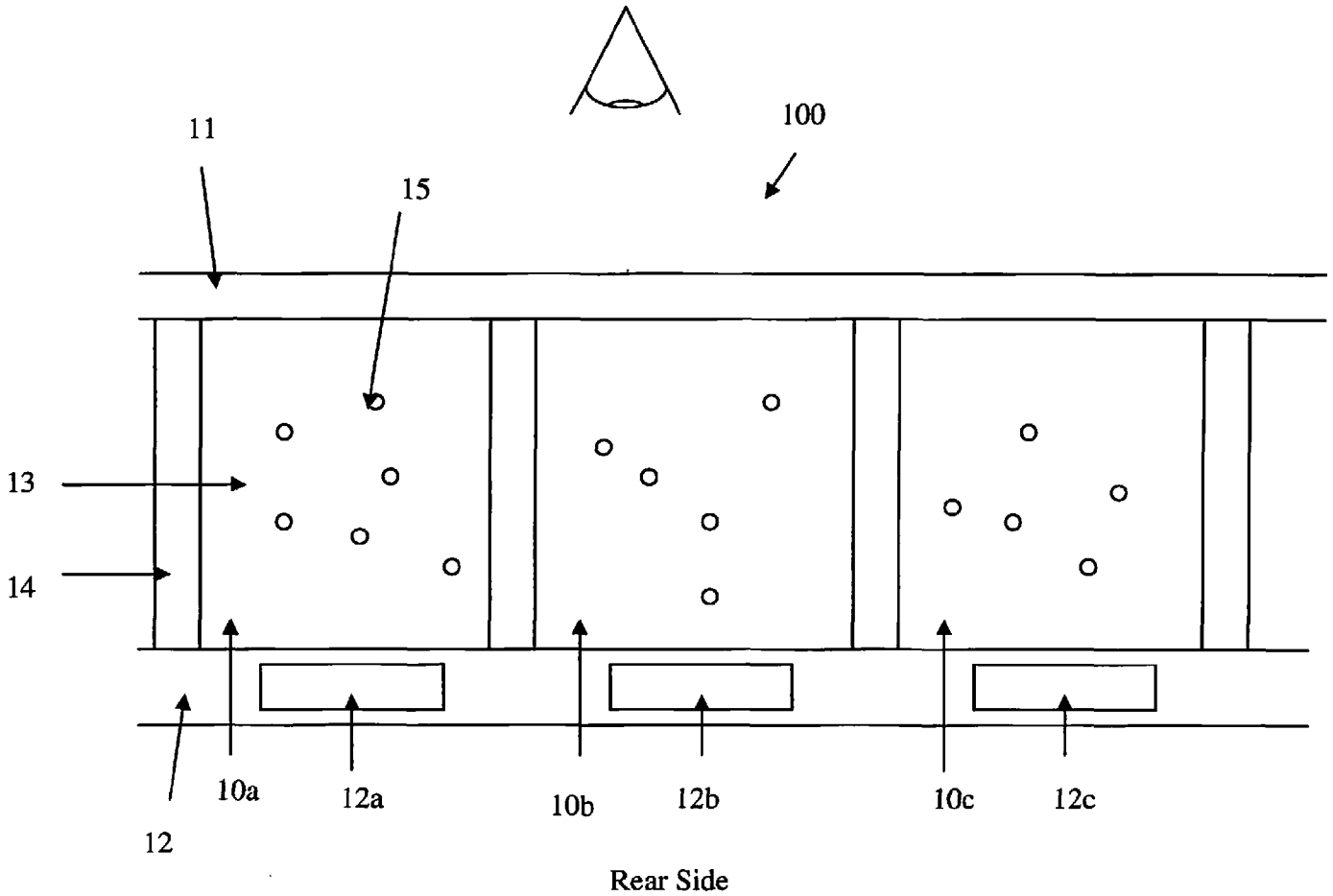
FIG. 1 is a cross-section view of a typical electrophoretic display device.

FIG. 1 illustrates an electrophoretic display (100) in general. The display typically comprises an array of electrophoretic display cells 10*a*, 10*b* and 10*c*. In the figure, the electrophoretic display cells, on the front viewing side indicated with the graphic eye, are provided with a common electrode 11 (which is usually transparent and therefore on the viewing side). On the opposing side (i.e., the rear side) of the electrophoretic display cells, there is a backplane (12). In one embodiment, the backplane may comprise discrete pixel electrodes 12*a*, 12*b* and 12*c*. Each of the pixel electrodes defines an individual pixel of the display.

However, in practice, a plurality of display cells (as a pixel) may be associated with one discrete pixel electrode. The pixel electrodes may be segmented in nature rather than pixellated, defining regions of an image to be displayed rather than individual pixels. Therefore, while the term "pixel" or "pixels" is frequently used in this application to illustrate the present invention, the structure and driving method are also applicable to segmented displays.

It is also noted that the display device may be viewed from the rear side when the backplane 12 and the pixel electrodes are transparent.

An electrophoretic fluid 13 is filled in each of the electrophoretic display cells.

The movement of the charged particles in a display cell is determined by the voltage potential difference applied to the common electrode and the pixel electrode associated with the display cell in which the charged particles are filled.

As an example, the charged particles 15 may be positively charged so that they will be drawn to a pixel electrode or the common electrode, whichever is at an opposite voltage potential from that of charged particles. If the same polarity is applied to the pixel electrode and the common electrode, the positively charged pigment particles will then be drawn to the electrode which has a lower voltage potential.

In another embodiment, the charged pigment particles 15 may be negatively charged.

The charged particles 15 may be white. Also, as would be apparent to a person having ordinary skill in the art, the charged particles may be dark in color and are dispersed in an electrophoretic fluid 13 that is light in color to provide sufficient contrast to be visually discernable.

In a further embodiment, the electrophoretic display fluid could also have a transparent and colorless solvent or solvent mixture and charged particles of two different colors carrying opposite particle charges and/or having differing electro-kinetic properties. For example, there may be white pigment particles which are positively charged and black pigment particles which are negatively charged and the two types of pigment particles are dispersed in a clear solvent or solvent mixture.

The term "display cell" is intended to refer to a microcontainer which is individually filled with a display fluid. Examples of "display cell" include, but are not limited to, microcups, microcapsules, micro-channels, other partition-typed display cells and equivalents thereof.

In the microcup type, the electrophoretic display cells may be sealed with a top sealing layer. There may also be an adhesive layer between the electrophoretic display cells and the common electrode 11. Each of the microcup-based electrophoretic display cells is surrounded by display cell walls 14.

In this application, the term "driving voltage" is used to refer to the voltage potential difference experienced by the charged particles in the area of a pixel: The driving voltage is the potential difference between the voltage of the common electrode and the voltage applied to the pixel electrode. For example, in a binary system where positively charged white particles are dispersed in a black solvent, when the common electrode has a zero voltage and a voltage of +15V is applied to a pixel electrode, the "driving voltage" for the charged pigment particles in the area of the pixel would be +15V. In this case, the driving voltage would move the white particles to be near or at the common electrode and as a result, the white color is seen through the common electrode (i.e., the viewing side). Alternatively, when the common electrode has a zero voltage and a voltage of −15V is applied to a pixel electrode, the driving voltage in this case would be −15V and under such −15V driving voltage, the positively charged white particles would move to be at or near the pixel electrode, causing the color of the solvent (black) to be seen at the viewing side.

Figure 2:
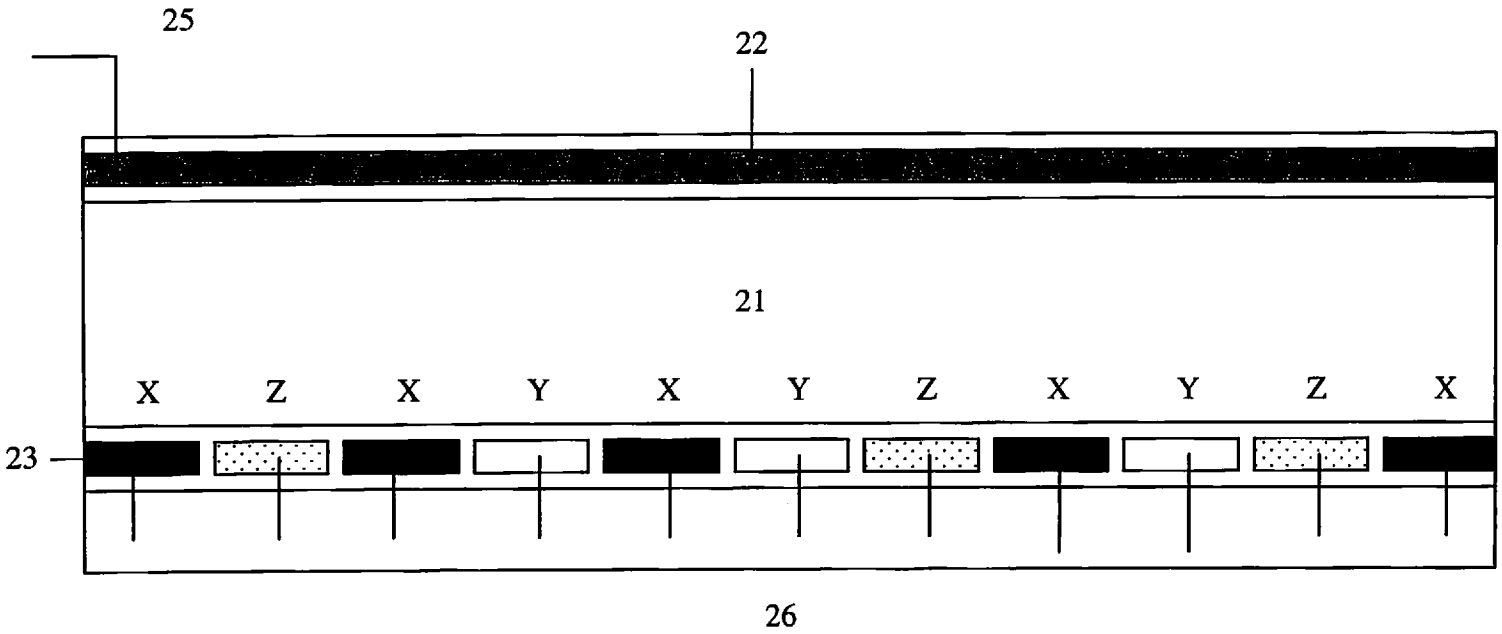
Prior Art Figure 2
FIG. 2 shows a prior art driving method.

FIG. 2 is a simplified diagram illustrating the prior art method currently used. A display cell layer (21) is sandwiched between a common electrode (22) and a backplane (23) comprising an array of pixel electrodes (X, Y & Z). The common electrode and the backplane are controlled by separate circuits, the common electrode driving circuit 25 and the backplane driving circuit 26. Both circuits 25 and 26 are connected to a display driver (not shown).

When driving from an image to another, in the updated areas (where the pixels change color states), a first voltage ($V_1$) is applied to the common electrode 22 by the display driver through the common electrode driving circuit 25, a second voltage ($V_2$) is applied to pixel electrodes X, and a third voltage ($V_3$) is applied to pixel electrodes Y. The driving voltage ($V_2-V_1$) would drive the pixels corresponding to pixel electrodes X from a first color state to a second color state and the driving voltage ($V_3-V_1$) would drive the pixels corresponding to pixel electrodes Y from the second color state to the first color state.

For the non-updated pixels (Z), the voltage of the common electrode must be substantially equal to the voltage applied to the pixel electrodes (i.e., zero driving voltage). However, in practice, it is very difficult to match precisely the voltage applied to the common electrode and the voltage applied to a pixel electrode. This could be due to the biased voltage experienced by the pixel electrodes. The prior art method also has other disadvantages. For example, in order to connect the common electrode to a driver so that a voltage may be applied to the common electrode, complex driving circuits and contact points are inevitably needed.

The first aspect of the present invention is directed to an electrophoretic display device, which comprises a) a plurality of display cells sandwiched between a floating common electrode and a backplane comprising multiple pixel electrodes and said backplane is connected to a display driver; and b) each of said display cells is filled with an electrophoretic fluid comprising charged pigment particles dispersed in a solvent or solvent mixture.

The term "floating" common electrode is referred to a common electrode which is not connected to a display driver, ground or any voltage supplying sources.

In one embodiment, the backplane is permanently attached to the plurality of display cells. In other words, the display cells are permanently sandwiched between the common electrode and the backplane.

In another embodiment, the backplane is detachable from the display cells. The backplane is only attached to the display cells when the display device is in the driving mode. This embodiment is particularly advantageous in terms of operation and costs.

The voltage of a floating common electrode may be calculated from the following equation:

$$V_{com}=\Sigma(V_{(i)}x\%\text{ of the pixels}(i)\text{ in the total number of pixels})$$

wherein the notation "i" indicates a particular group of pixels. Therefore, $V_{com}$ is the summation of voltage applied to a group of pixels times the percentage of the pixels of the group in the total number of pixels.

In the present invention, $V_{com}$ is designed to be substantially zero.

The second aspect of the invention is directed to driving methods for a display device as described above. In these driving methods, the backplane is either permanently attached to the display cells or temporarily attached to the display cells.

Figure 3:
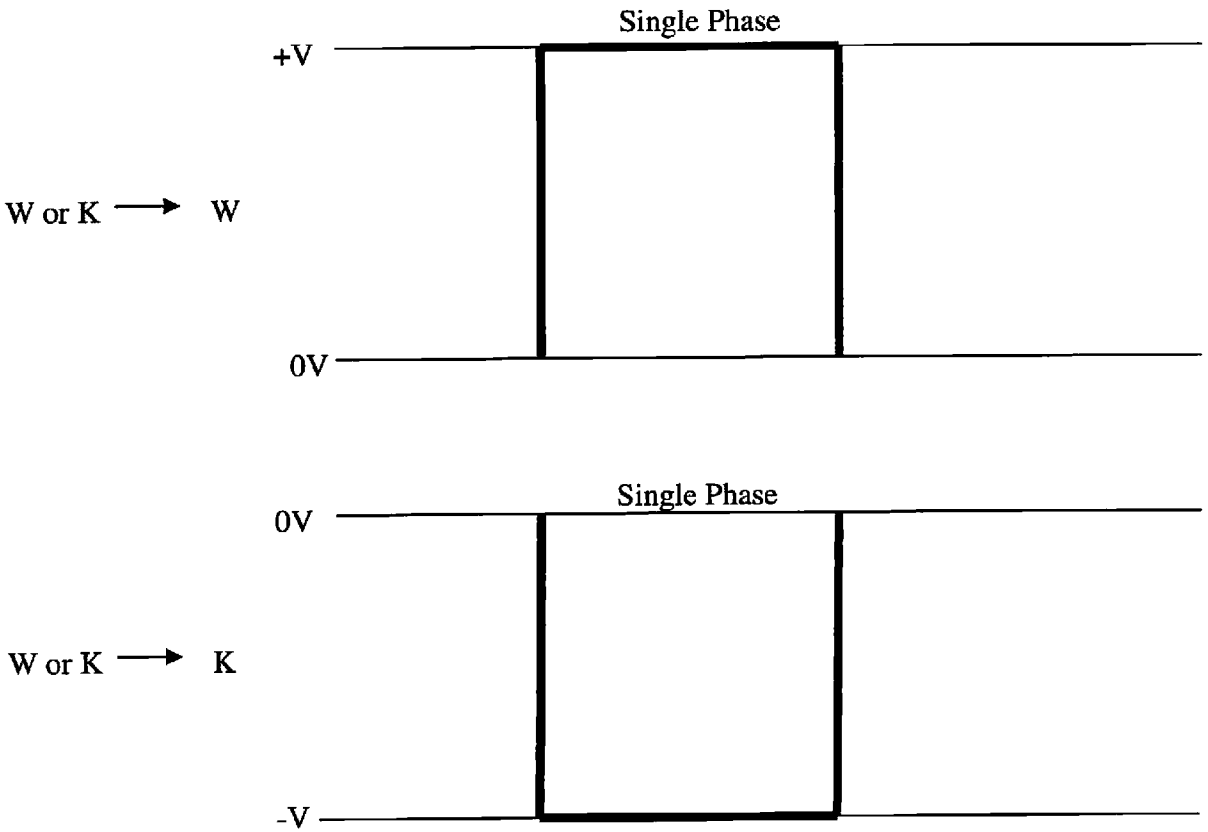
FIG. 3 depicts waveforms of a single phase for a driving method of the present invention.

In one embodiment, a driving method for a display device as described above employs waveforms of a single driving phase, as shown in FIG. 3. The method comprises a) applying a +V to a first group of pixels;

b) applying a −V to a second group of pixels; and c) applying 0V to the remaining pixels, if any, wherein the voltage of the floating common electrode, $$V_{com}=(+V)\times(\%\text{ of the first group of pixels in all pixels})+(-V)\times(\%\text{ of the second group of pixels in all pixels})+(0V)\times(\%\text{ of the remaining pixels, if any, in all pixels})$$

and is substantially zero.

As expressed, one essential feature of the driving method is that the voltage experienced by the floating common electrode is controlled to be substantially zero. The term "substantially" refers to about less than 5% of the full driving voltage. For example, if the full driving voltage is +1V in order to drive a pixel to a full color state, then the $V_{com}$, in this case, is between +0.05V and −0.05V, and in other words, the driving voltage is at least +0.95V.

To achieve a substantially 0V for the floating common electrode, there may be a group of pixels which are applied zero driving voltage while half of the remaining pixels are applied a voltage of +V and the other half of the remaining pixels are applied a voltage of −V.

Figure 4:
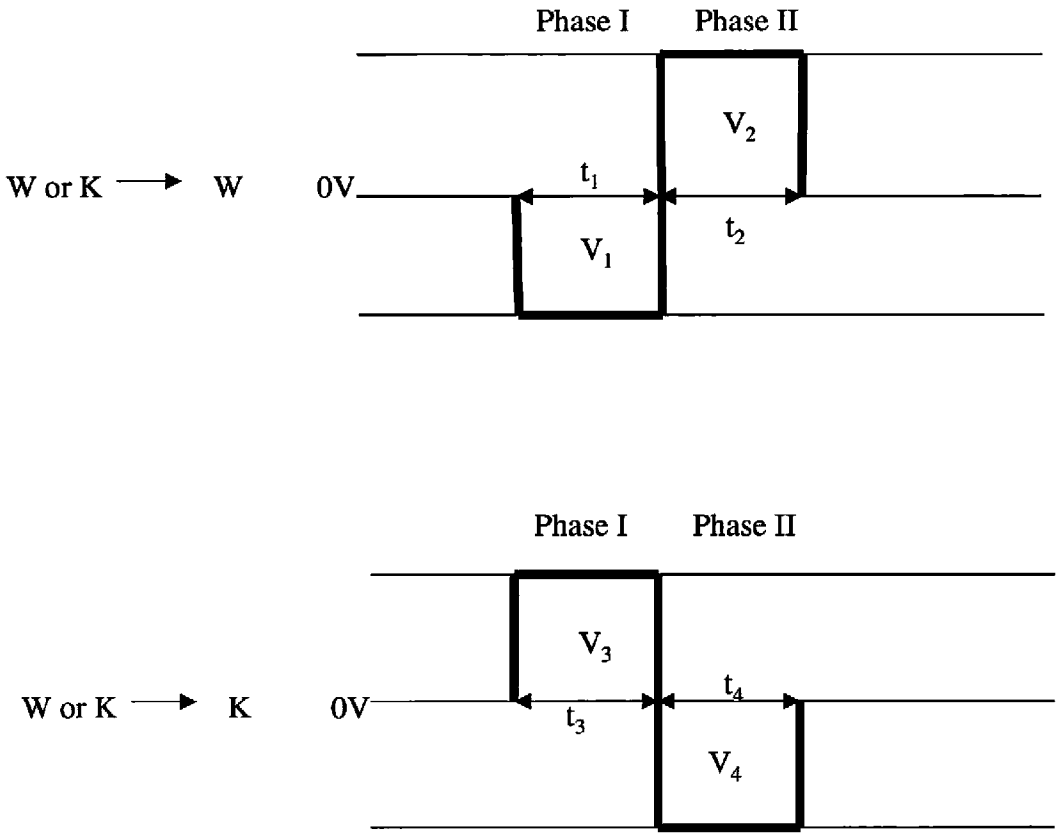
FIG. 4 depicts waveforms of two phases for a driving method of the present invention.

In another embodiment, a driving method for a display device as described above employs waveforms of two driving phases, as shown in FIG. 4. The display device is of a binary color system comprising a first color and a second color and the method comprises d) applying a voltage of $V_1$ for a period of $t_1$ and then a voltage of $V_2$ for a period of $t_2$, to a first group of pixels to drive said pixels to the first color state or to remain in the first color state;

e) applying a voltage of $V_3$ for a period of $t_3$ and then a voltage of $V_4$ for a period of $t_4$, to a second group of pixels to drive said pixels to the second color state or to remain in the second color state; and f) applying 0V to the remaining pixels, if any, wherein the voltage of the floating common electrode, $$V_{com}=V_2\times(\%\text{ of the first group of pixels in all pixels})+V_4\times(\%\text{ of the second group of pixels in all pixels})+0V\times(\%\text{ of the remaining pixels, if any, in all pixels})$$

and is substantially zero and $t_2=t_4$.

In one embodiment, the sum of $$V_1\times(\%\text{ of the first group of pixels in all pixels})+V_3\times(\%\text{ of the second group of pixels in all pixels})+0V\times\%\text{ of the remaining pixels, if any, in all pixels})$$

is also substantially zero and $t_1=t_3$.

In practice, it is possible for the waveforms to have more than two phases.

The driving method is carried out in multiple steps, and the voltages applied to each group of the pixels and the percentage of each group of the pixels in the total number of the pixels need to be carefully tuned, which are demonstrated in the examples below.

EXAMPLES

Example 1

Figure 5B:
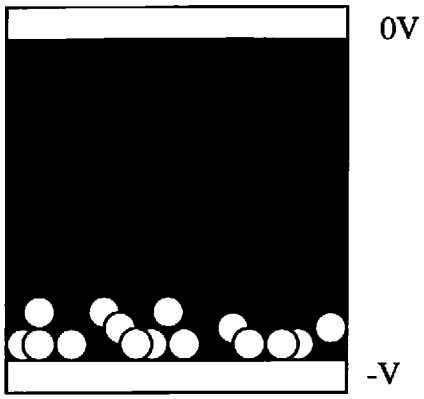
FIGS. 5*a* and 5*b* show a display cell displaying two color states.
Figure 5A:
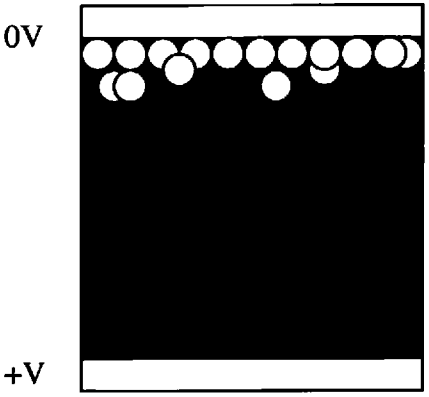

In order to illustrate the present driving method, it is assumed that the display cells are filled with an electrophoretic fluid comprising positively charged white particles dispersed in a black colored solvent, as shown in FIGS. 5*a* and 5*b*.

FIG. 3, as stated above, illustrates a single phase driving scheme.

When a driving voltage of +V is applied to a display cell, the display cell will display a white color state at the viewing side (see FIG. 5*a*). The initial color of the display cell may be black which will be driven to white after a driving voltage of +V is applied. If the initial color of the display cell is white, the display cell will remain in the white color state after a driving voltage of +V is applied.

When a driving voltage of −V is applied to a display cell, the display cell will display a black color state at the viewing side (see FIG. 5*b*). The initial color of the display cell may be white which will be driven to black after a driving voltage of −V is applied. If the initial color of the display cell is black, the display cell will remain in the black color state after a driving voltage of −V is applied.

FIG. 4, as stated above, illustrates a two-phase driving scheme. When a driving voltage of −V (i.e., $V_1$) (in phase I) and then a driving voltage of +V (i.e., $V_2$) (in phase II) are applied to a display cell, the display cell will display a white color state at the viewing side (see FIG. 5*a*). The initial color of the display cell may be black which will remain in black (in phase I) and then be driven to white (in phase II). If the initial color of the display cell is white, the display cell will be driven to black first (in phase I) and then back to white (in phase II). In either case, the end color is white.

When a driving voltage of +V (i.e., $V_3$) (in phase I) and then a driving voltage of −V (i.e., $V_4$) (in phase II) are applied to a display cell, the display cell will display a black color at the viewing side (FIG. 5*b*). The initial color of the display cell may be black which will be driven to white (in phase I) and then back to black (in phase II). If the initial color of the display cell is white, the display cell will remain in white first (in phase I) and then be driven to black (in phase II). In either case, the end color is black.

In the waveforms of FIG. 4, it is assumed that $t_1=t_3$ and $t_2=t_4$.

Example 2

It is further assumed that the final image display would have 80% white pixels and 20% black pixels. In other words, the 80% white/20% black image is the target image to be achieved by the driving method, which is carried out in the following steps:

Step 1: Fifty percent (50%) of the pixels are driven to white and fifty percent (50%) of the pixels are driven to black. In other words, 50% of the pixel electrodes are applied a voltage of +V and 50% of the pixel electrodes are applied a voltage of −V (according to the waveforms of FIG. 3).

Consequently, $V_{com}$ may be calculated from the equation:

$$V_{com}=(+V)\times 0.5+(-V)\times 0.5=0V$$

Step 2: The 50% of the white pixels achieved in step 1 would be kept white; thus no driving voltage being applied to those pixels in step 2. Among the 50% of the black pixels achieved in step 1, half of which (i.e., 25% of total) are applied a voltage of +V and the remaining half (i.e., 25% of total) would be applied a voltage of −V.

As a result, $V_{com}$ would become (0V)×0.5+(+V)×0.25 and (−V)×0.25, which is equal to 0V.

The end result of this step is that 75% of the pixel would be white and 25% of the pixels would be black.

Step 3: The 75% of the white pixels achieved in the previous steps would be kept white, thus no driving voltage being applied to those pixels.

Among the 25% black pixels, 60% (i.e., 15% of total) of them would be kept black, thus no driving voltage being applied to those pixels. The remaining 20% of the black pixels (i.e., 5% of total) are applied a voltage of +V to be driven to white and the other 20% of the black pixels (i.e., 5% of total) are applied a voltage of −V to be driven to black.

As a result, Vcom would become (0V)×0.75+(0V)×0.15+(+V)×0.05 and (−V)×0.05, which is equal to 0V.

The end result of this step is that 80% of the pixels would be white and 20% of the pixels would be black, which is the target image of the driving method.

It is noted that while the waveforms of FIG. 3 are used in this example, the method may be easily carried out with the waveforms of FIG. 4.

Example 3

This example illustrates the steps of Example 2 in a graphic manner. FIG. 6 shows an image consisting of 20 pixels, 1-20. FIG. 7*c* is the target image in which 80% of the pixels (1, 2, 4, 6-10, 12-15, 16 and 18-20) are white and 20% of the pixels (3, 5, 11 and 17) are black.

Following step 1 of Example 1, 50% of the pixels (4, 7, 9, 10, 13, 15, 16, 18, 19 and 20) are driven to white and the remaining 50% of the pixels (1, 2, 3, 5, 6, 8, 11, 12, 14 and 17) are driven to black to achieve an intermediate image as shown in FIG. 7*a*.

In step 2, the white pixels achieved in step 1 would be kept white. Among the black pixels achieved in step 1, half of which (2, 6, 8, 12 and 14) are driven to white and the remaining half (1, 3, 5, 11 and 17) are driven to black. The end result of step 2, as shown in FIG. 7*b*, is that 15 pixels (2, 4, 6-10, 12-15, 16 and 18-20) would be white and 5 pixels (1, 3, 5, 11 and 17) would be black.

In step 3, the white pixels achieved in steps 1 and 2 would be kept white. Among the black pixels achieved, 3 pixels (3, 5 and 11) would be kept black. Among the remaining the black pixels, 1 pixel (1) is driven to white and the other pixel (17) is driven to black.

The end result of this step is that 80% of the pixels would be white and only 20% of the pixels (3, 5, 11 and 17) would be black, which is the target image of the driving method.

The examples above demonstrate a simple driving method with common electrode unconnected to a display driver. As stated, the method may be modified by applying waveforms in each step to drive the pixels to either black or white for better image quality. For example, instead of directly driving pixels to the white state, the pixels may be driven to the full black state first and then to the white state. Likewise, instead of directly driving pixels to the black state, the pixels may be driven to the full white state first and then to the black state.

Therefore, either the waveforms of FIG. 3 or the waveforms of FIG. 4 may be used for the driving method of the present invention. It is also noted that the waveforms may have more than two phases, if necessary.

While the colors of black and white are specifically mentioned in the examples, the present method can be used in any binary color systems as long as the two colors provide sufficient contrast to be visually discernable. Therefore the two contrasting colors may be broadly referred to as "a first color" and "a second color".

Figure 8:
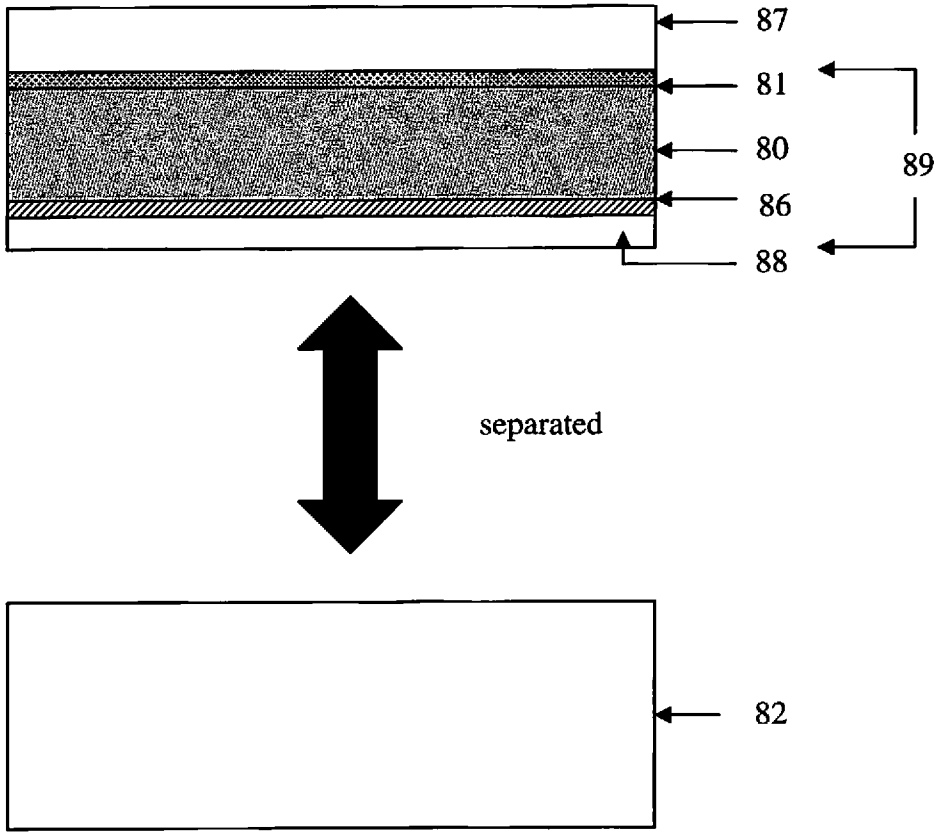
FIG. 8 illustrates a backplane-less design of the present invention.

The display structure and the driving method as described above are particularly useful in a scenario where the backplane is not permanently attached to the display cell layer, as shown in FIG. 8. In this design, a display device (89) comprises a display cell layer (80) in which each of the display cells is filled with an electrophoretic fluid, a common electrode (81) and an optional protective layer (88) laminated to the display cell layer (80) with an adhesive (86). The layer (87) is a substrate layer. The backplane (82) is separated from the display cell layer.

Figure 9A:
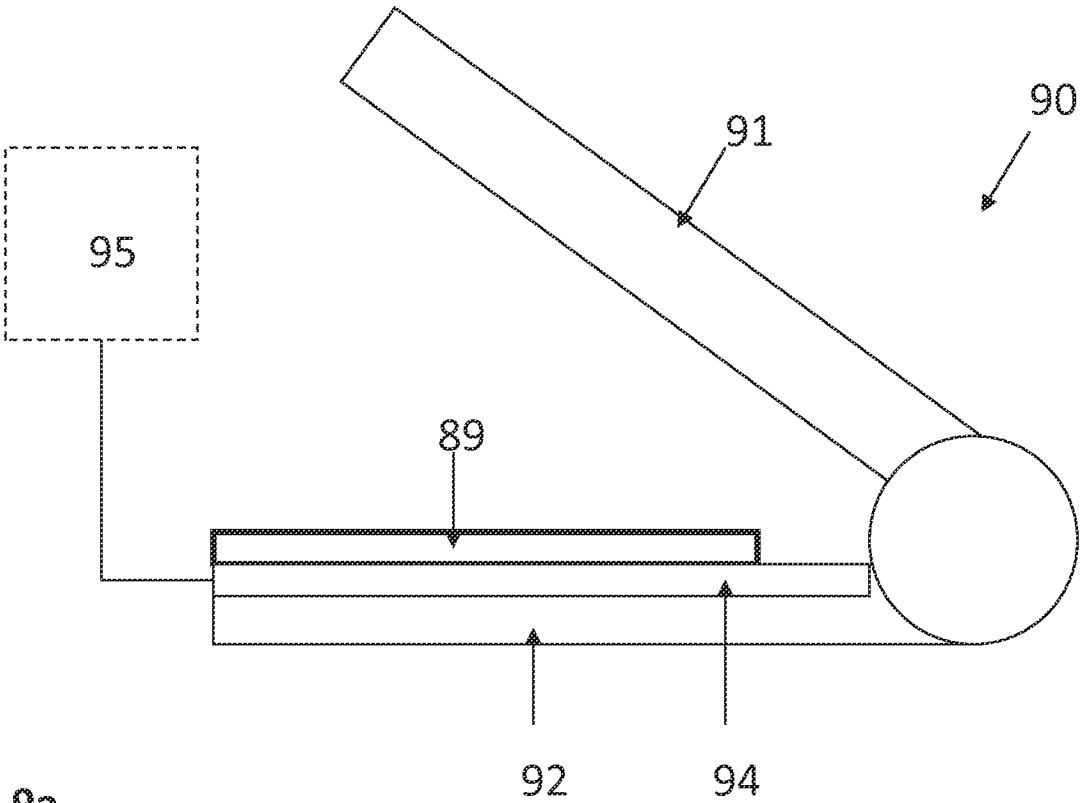
FIGS. 9*a* and 9*b* show a writer device utilizing the present display structure.
Figure 9B:
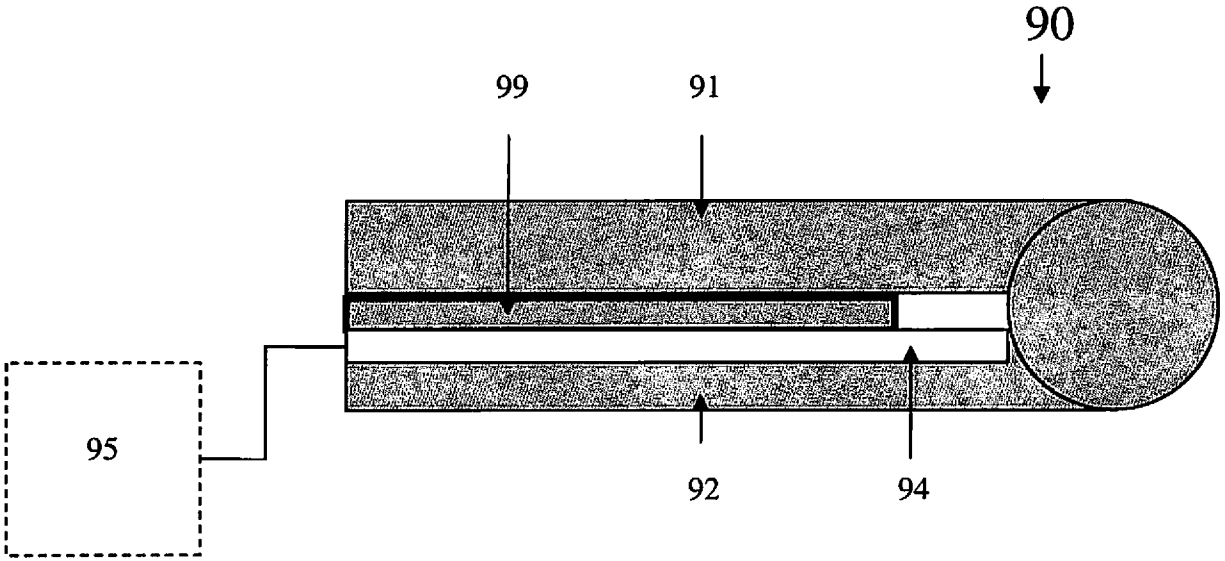

FIGS. 9*a* and 9*b* show a cross-section view of a writer device (90) utilizing the display structure of the present invention. The writer device has a lid (or cover) (91), a body (receptacle) (92) and a display driver (95).

The body (or receptacle) (92) of the device comprises a backplane (94). The backplane may be a segmented electrode layer (for simple signs) or an active matrix driving system (for more complicated images).

The writer device (90) may be in an open (FIG. 9*a*) or closed (FIG. 9*b*) position.

Only the backplane (94) is connected to the display driver (95) in the display device. The common electrode (81) is not connected to the display driver (95) in the display device.

When a display device (e.g., 89) in FIG. 8 needs to display an image or an image needs to be altered or updated, the display is placed into the receptacle (92) of the writer device. When the writer device is closed (see FIG. 9*b*) with the display in it, the display is pressed to be in contact with the backplane (94).

The display driver issues signals to the circuit to apply appropriate voltages to the backplane (94). The display is then driven to desired images according to the driving method of the present invention.

After updating, the display may be removed from the writer device.

More display devices with separate backplane are described in U.S. Ser. No. 61/248,793, the whole content of which is hereby incorporated by reference in its entirety.

Although the foregoing disclosure has been described in some detail for purposes of clarity of understanding, it will be apparent to a person having ordinary skill in that art that certain changes and modifications may be practiced within the scope of the appended claims. It is noted that the present invention is applicable to any bistable display devices. Accordingly, the present embodiments are to be considered as exemplary and not restrictive, and the inventive features are not to be limited to the details given herein, but may be modified within the scope and equivalents of the appended claims.

What is claimed is:

1. A driving method for a display device of a binary system comprising a first color and a second color, wherein the display device comprises:

A) a plurality of display cells sandwiched between a floating common electrode and a backplane comprising multiple pixel electrodes and said backplane is connected to a display driver; and B) each of said display cells is filled with an electrophoretic fluid comprising charged pigment particles dispersed in a solvent or solvent mixture; the driving method comprising:

a applying a voltage of $V_1$ for a period of $t_1$ in phase I and a voltage of $V_2$ for a period of $t_2$ in phase II, to a first group of pixel electrodes to drive the corresponding pixels to the first color state or to remain in the first color state, wherein the number of the first group of pixels is less than the number of all pixels of the display device;

b) applying a voltage of $V_3$ for a period of $t_3$ in the phase I and a voltage of $V_4$ for a period of $t_4$ in the phase II, to a second group of pixel electrodes to drive the corresponding pixels to the second color state or to remain in the second color state, wherein the number of the second group of pixels is less than the number of all pixels of the display device; and c) applying 0V to the remaining pixel electrodes, if any, to cause the voltage of the floating common electrode to be substantially zero, according to the following equation:

$$V_{com}=V_1\times(\%\text{ of the first group of pixels in all pixels})+V_3\times(\%\text{ of the second group of pixels in all pixels})+0V\times(\%\text{ of the remaining pixels in all pixels}),\text{ or}$$

$$V_{com}=V_2\times(\%\text{ of the first group of pixels in all pixels})+V_4\times(\%\text{ of the second group of pixels in all pixels})+0V\times(\%\text{ of the remaining pixels in all pixels})$$

wherein $t_1=t_3$ and $t_2=t_4$, and during both the phase I and phase II, the floating common electrode is not directly connected to a display driver, ground or any voltage supplying source.

2. The method of claim 1, wherein said backplane is a permanent feature of the display device.

3. The method of claim 1, wherein said plurality of display cells are sandwiched between the floating common electrode and the backplane only when the display device is in the driving mode.

4. The method of claim 1, wherein said display device is an information display device.

5. The method of claim 1, wherein said display device is an electronic price tag.

6. The method of claim 1, wherein said plurality of display cells are sandwiched between the floating common electrode and the backplane only when the display device is in the driving mode.

7. The method of claim 1, wherein said first and second colors are black and white respectively.

* * * * *